United States Patent [19]

Roehm et al.

[11] Patent Number: 4,753,098

[45] Date of Patent: Jun. 28, 1988

[54] METHOD AND APPARATUS FOR FORMING A TUBE

[75] Inventors: Earl Roehm; William Toy; Jerry Lamb; Clyde Morehead; Ernest Bivens; Jerry Niehaus, all of Evansville, Ind.

[73] Assignee: Process Engineering, Inc., Evansville, Ind.

[21] Appl. No.: 30,367

[22] Filed: Mar. 26, 1987

[51] Int. Cl.[4] ..... B21D 11/07

[52] U.S. Cl. ..... 72/383; 72/385; 140/105

[58] Field of Search ..... 72/383, 385, 384, 386; 140/105, 90

[56] References Cited

U.S. PATENT DOCUMENTS

| | | | |
|---|---|---|---|
| 2,086,736 | 7/1937 | Palmer | 72/385 |
| 2,661,787 | 12/1953 | Eidal | 72/383 |
| 3,657,914 | 4/1972 | Hart | 72/383 |
| 3,722,254 | 3/1973 | Katogir | 72/383 |
| 4,351,178 | 9/1982 | Uehara | 72/383 |

FOREIGN PATENT DOCUMENTS

| | | | |
|---|---|---|---|
| 5300 | 3/1965 | Japan | 72/385 |
| 2307 | 1/1976 | Japan | 72/385 |
| 48427 | 4/1980 | Japan | 72/385 |
| 75224 | 5/1982 | Japan | 72/385 |

*Primary Examiner*—David Jones

*Attorney, Agent, or Firm*—Larson and Taylor

[57] ABSTRACT

A method and apparatus for forming tubes, rods and the like into a serpentine configuration. A plurality of guide rails are mounted on a supporting surface and carriage bars are slideable on the guide rails. A lazy tong linkage having bend forming members mounted thereon is slideably mounted on the carriage bars. A lazy tong linkage assembly is disposed on each side of a center line and expander mechanisms are provided for forcing the two spaced lazy tong linkages apart. Drive means connected to the carriage bars drives the lazy tong linkage to a collapsed position and this movement causes the bend forming members to form a straight tube or rod into a serpentine configuration.

11 Claims, 3 Drawing Sheets

2
11
11
17
25
16
25
24
25
16
25
16
2
16
17
11
11
5
4
2
6
6
3
3
3
2
4
4

METHOD AND APPARATUS FOR FORMING A TUBE

The present invention relates to a rod into a serpentine configuration suitable, for example, as a refrigeration coil.

BACKGROUND OF THE INVENTION

The prior art discloses many different types of devices for forming bends in rods or tubes and includes devices which form each bend as a single operation and devices which attempt to simultaneously form a plurality of bends in a zigzag configuration. The U.S. Pat. No. 2,097,193 Jacobs discloses a wire bending machine in which pins are mounted on rotating disks and as wire is passed between the disks the pins produce bends in the wire. The U.S. Pat. No. 2,497,500 Hightower discloses a pipe bender and straightener in which a pipe is passed over a shaping head and rollers disposed on a pivoted linkage force the pipe into the shape of the head.

There are a number of prior art patents which disclose mechanisms including pivoted linkages which are adapted to engage opposite sides of a straight bar or tube and, by pivoting the links bend the bar into a serpentine configuration. Patents of this type are U.S. Pat. Nos. 3,657,914 Hart, 2,661,787 Eidal and 2,086,736 Palmer. Other devices utilizing moveable forming heads in opposite directions include the patents to Uehara 4,351,178 and Katogir 3,722,254. Such prior art devices have not been entirely successful because of the difficulties in maintaining the appropriate spacing of the bending heads during the bending operation. More specifically, prior art devices tend to buckle the tubes, close the tubes during the bending operation or unduly stretch the tubes due to the difficulties in maintaining the proper spacing between the bending heads during the forming operation.

SUMMARY OF THE INVENTION

The present invention provides a mechanism for simultaneously forming all of the bends in a straight rod or tube so that a serpentine configuration is produced during a single forming operation. The mechanism provides means for precisely locating the bending points and for maintaining the tube in a precise alignment during the forming operation so that undue stresses and buckling do not occur.

According to the present invention a base structure supports bend forming means on each side of a center line extending longitudinally of the base. Each of the bend forming means includes a plurality of parallel guide rails which are secured to the supporting base. A plurality of carriage bars are slideably mounted on the guide rails and extend transversely with respect thereto. A lazy tong linkage is slideably mounted on the carriage bars so as to be moveable along the length of the carriage bars. Bend rollers are attached to the lazy tong linkages and drive means is provided for driving the lazy tongs from an opened to a collapsed position so that the bend rollers in engagement with a straight tube form bends in the tube so that the tube assumes a serpentine configuration. Expander means is provided between the tube bend forming means and this expander means forms the initial bend by forcing both lazy tong linkage systems outwardly and the expander means also functions to maintain the bend rollers in engagement with the tube throughout the entire forming operation. When the lazy tong linkage is in its completely collapsed condition the expander means is again activated to stretch the tube slightly in its serpentine configuration so that the tube will maintain this configuration when released from the tube bending means.

An object of the present invention is to provide a tube bending method and apparatus for converting a straight tube into a serpentine configuration in a single operation.

Another object of the present invention is to provide a tube bending apparatus and method which will form 180° bends in a tube without undue stress or buckling of the tube and which will provide a tube which will maintain a serpentine configuration when released from the tube bending mechanism.

Other objects and many of the attendant advantages will become more readily apparent upon consideration of the following detailed specification when considered in connection with the accompanying drawings wherein:

DESCRIPTION OF THE PREFERRED EMBODIMENT

Figure 1:
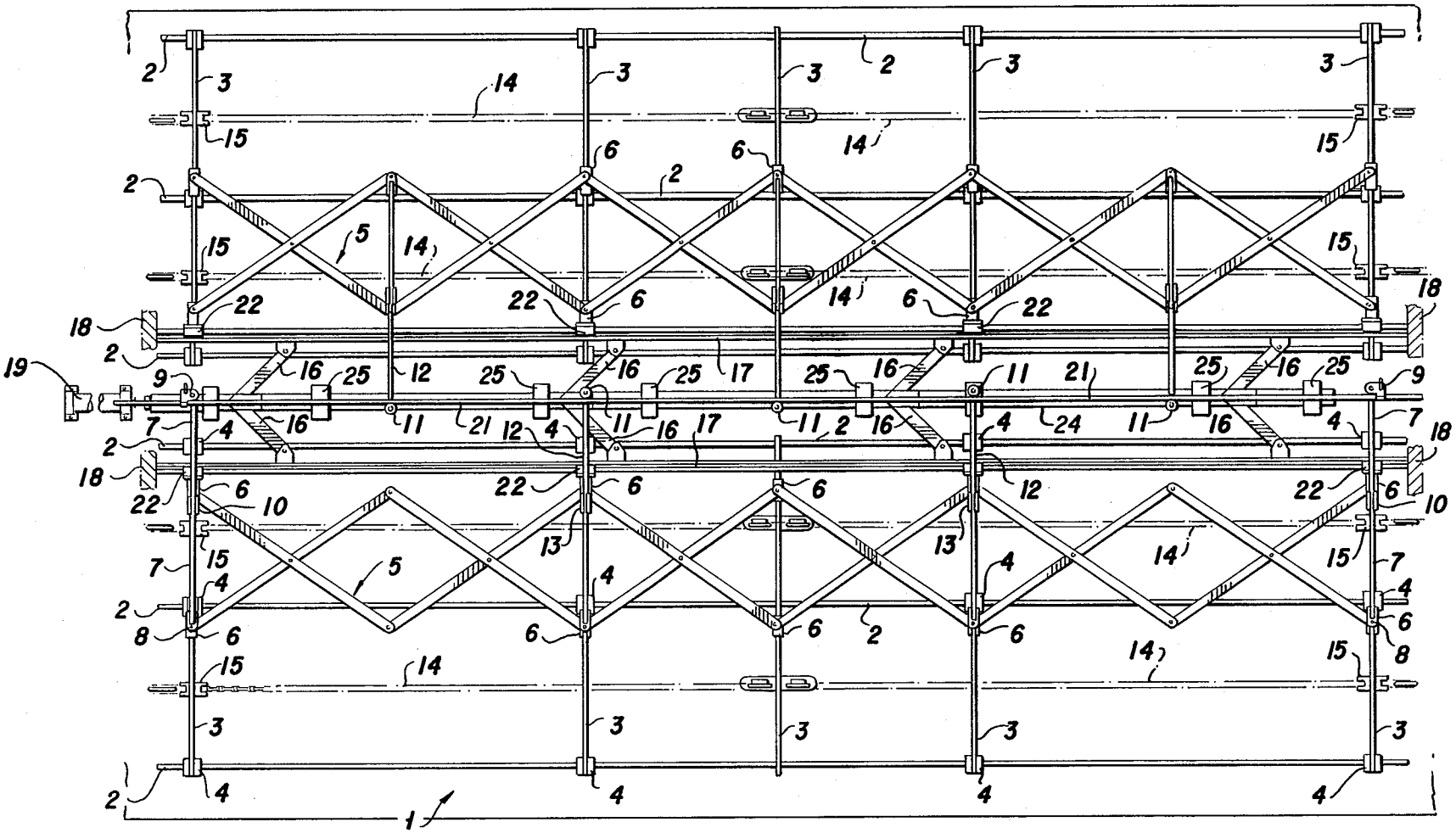
FIG. 1 is a plan view of the tube bending apparatus with a straight tube in position to be formed into a serpentine configuration.
Figure 2:
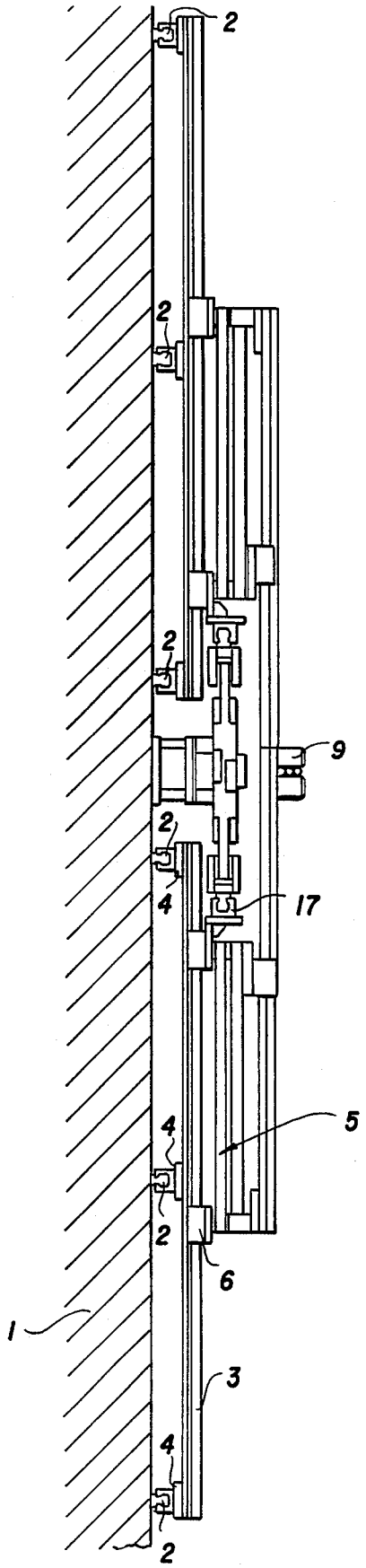
FIG. 2 is a side elevation of FIG. 1.

Referring now more specifically to the drawings wherein like numerals indicate like parts throughout the several views there is shown a supporting base 1 having a plurality of guide rails 2 secured thereto. Three guide rails 2 extend longitudinally of the supporting base on each side of the central portion of the base. Substantially identical tube bending mechanism is provided on each side of the supporting base as will be evident from the description hereinafter.

A plurality of carriage bars 3 extend transversely of the guide rails 2 on each side of the center of the supporting base. The central carriage bar 3 is fixed to the guide rails 2 and the two carriage bars 3 on each side of the center bar are slideably mounted on the guide rails 2 by means of grooved blocks 4. Thus, it can be seen that the carriage bars 3 can be moved longitudinally along the guide rails 2 to a position wherein the carriage bars are adjacent the stationary center rail 3.

There is provided a lazy tong linkage identified generally by the reference numeral 5 which is innerconnected with the carriage bars 3 through sleeves 6 which are slideable on the carriage bars with the links of the lazy tongs 5 being pivotally mounted on the sleeves 6. Thus, as the lazy tongs are moved from an extended position as shown in FIG. 1 to a collapsed position as shown in FIG. 3 the links of the lazy tongs slide along the carriage bars 3.

The outermost carriage bars 3 on one side of the center line of the supporting table are provided with clamping rods 7 which have one end thereof pivoted at 8 to the support sleeve 6. The opposite end of the rods 7 extend beyond the inner guide rail 2 and have a tube clamp 9 mounted on the end thereof. It can be seen in FIG. 1 that a tube 21 which is to be bent is engaged at each end thereof by a tube clamp 9 and the tube clamps 9 hold the tube 21 firmly throughout the bending operation. Flanges 10 mounted on the sleeves 6 maintain the rods 7 in alignment with the carriage bars 3.

The mechanism for bending the tube comprises a plurality of bend rollers 11 which are disposed alternately on opposite sides of the tube 21. These rollers are rotatably supported by support rails 12. Support rails 12 have the opposite ends thereof pivotably mounted on the sleeves 6 and the central portions of the support rails 12 are supported by flanges 13 extending from the other set of sleeves 6 which support the lazy tong linkage.

Figure 3:
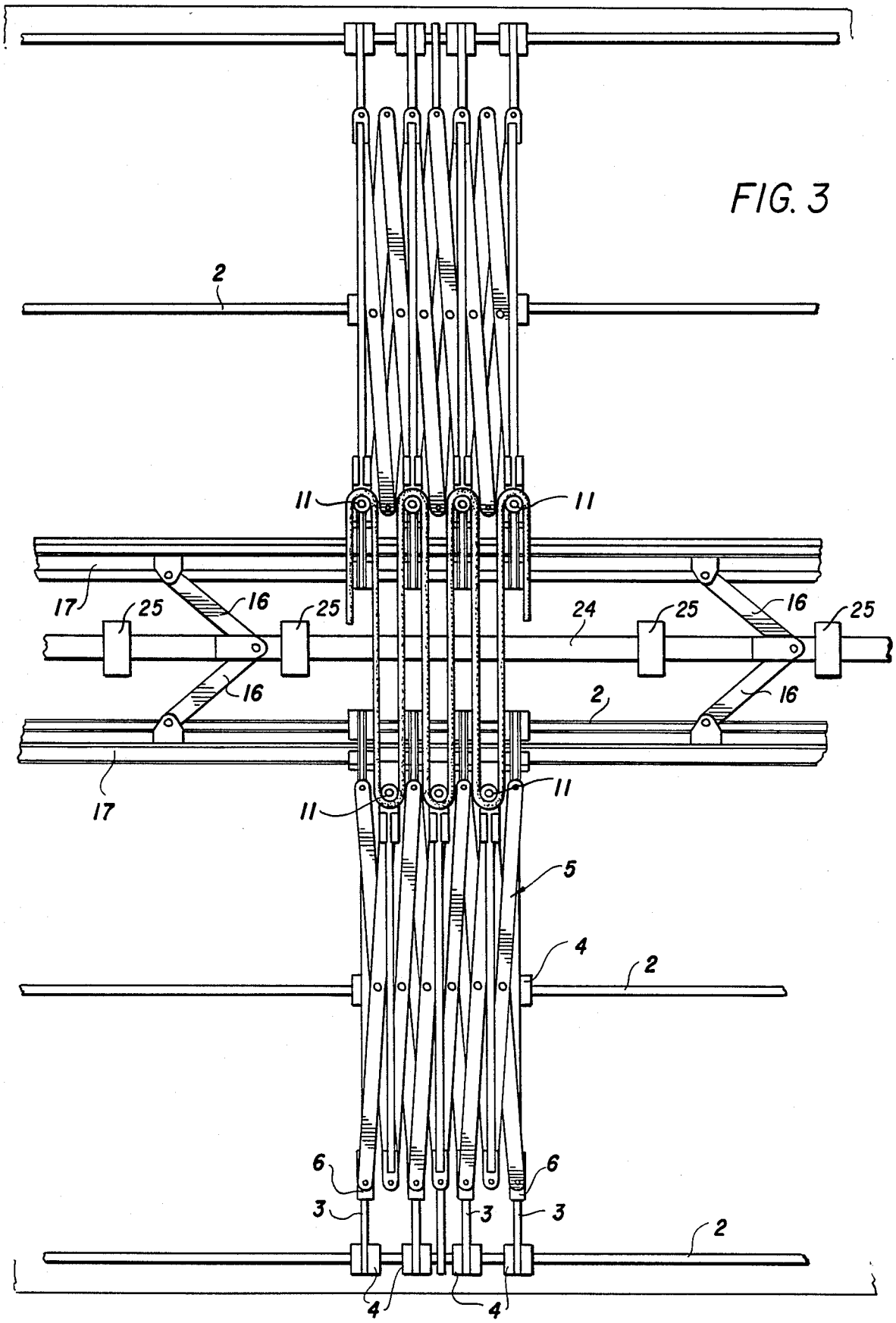
FIG. 3 is a plan view of the apparatus showing the tube forming operation completed.

The drive means for driving the lazy tongs linkage 5 between extended positions as shown in FIG. 1 and collapsed position as shown in FIG. 3 comprises a chain drive 14 which has a dolly block 15 thereon engageable with the outermost carriage bars 3. As shown in FIG. 1 there are four chain drives provided for each side of the bending mechanism and the chain drives are driven synchronously to simultaneously move all of the carriage bars between the positions shown in FIGS. 1 and 3. Obviously other types of drive means may be utilized to drive the lazy tongs linkage between extended and collapsed positions. It can be seen that, as the lazy tong linkage is moved from the extended position shown in FIG. 1 to the collapsed position shown in FIG. 3, the bend rollers 11 and support arms 12 are drawn outwardly and this movement creates 180° bends in the tube around each bend roller.

Centrally of the bend forming means there is provided an expander mechanism comprising an expander bar 24 which extends centrally of the mechanism directly beneath the tube 21 as shown in FIG. 1. The expander bar 24 is slideably mounted on the base 1 by a plurality of apertured blocks 25 fixed to the base 1. A plurality of sets of links 16 are pivotably mounted on the expander bar 24 and the outer ends of the links 16 are pivotably mounted on an expander guide rail 17. The expander guide rails 17 are slidably received within semicircular shaped bosses 22 secured to the sleeves 6. Elongated blocks 18 mounted on the base 1 engage the end faces of the expander guide rails 17 to prevent movement of the expander guide rails 17 along the longitudinal axis of the guide rails. A motor operated hydraulic cylinder 19 is provided at one end of the expander bar 24 and actuation of the hydraulic cylinder causes longitudinal movement of the expander bar 24. The longitudinal movement of the expander bar 24 forces the links 16 outwardly as the expander guide rails 17 to which the opposite ends of links 16 are pivoted cannot move longitudinally. The outward movement of links 16 and expander rails 17 exerts outward pressure on the lazy tong linkages 5 through the engagement of the expander guide rail 17 with the sleeves 6 which are slideable on the carriage bars 3 and pivotably mounted on the lazy tong linkage.

The expander bar mechanism performs three functions in the operation of the tube bending apparatus. When the tube 21 is initially clamped by clamps 9 in the mechanism with the bend rollers 11 positioned as shown in FIG. 1, a low pressure actuation of the hydraulic cylinder forces the lazy tong linkage outward slightly thus causing an initial slight bending of the tube 21 at those points where the tube is engaged by rollers 11. The drive mechanism 14 is then actuated to drive the lazy tongs towards collapsed position. During this movement of the lazy tong linkage 5 the expander bar mechanism maintains outward pressure against the lazy tong linkages to maintain the rollers 11 in engagement with the tube to provide for proper formation of the bend. The mechanism and hydraulic cylinder are so designed that the outward pressure against the lazy tongs acts in the nature of a spring force, and if the stress within the tube 21 caused by the bending exceeds a predetermined value, the lazy tongs may move inwardly slightly to maintain the stress at a predetermined value thus preventing buckling or collapse of the tube during bend formation. When the lazy tongs are in a collapsed position as shown in FIG. 3 the hydraulic cylinder 19 is again actuated with a higher pressure to force the lazy tongs apart thus tensioning the tube in its serpentine configuration. This tensioning will cause the tube to maintain its serpentine configuration when removed from the bend forming mechanism.

The present invention provides a method and apparatus for forming a tube into a serpentine configuration and a wide variety of bend diameters and bend to bend dimensions can be achieved by simple adjustment of the apparatus. The prior art devices are not capable of such simple adjustment.

Obviously many modifications and variations of the present invention are possible in light of the above teachings. What is claimed as new and is desired to be secured by Letters Patent is:

We claim:

1. An apparatus for forming bends in a tube or rod comprising a supporting base, means for supporting a tube or rod mounted on said supporting base, a plurality of guide rails fixed to said base disposed on one side of said tube support means, said guide rails extending in parallel relationship longitudinally of said base, a plurality of carriage bars extending transversely of said guide rails, means mounting said carriage bars for slidable movement along the length of said guide rails, a lazy tongs linkage, means mounting said lazy tongs linkage for slidable movement along the length of said carriage bars, bend forming means mounted on said lazy tong linkage and engageable with a surface of a tube or rod to be bent, drive means for simultaneously driving said carriage bars from a spaced apart position on said guide rails towards the center of said guide rails to cause said lazy tongs to slide along the carriage bars and draw said bend forming means outwardly to form a bend in a tube or rod engaged with said bend forming means, and expander means for forcing said lazy tong linkage outwardly on said carriage bars, said expander means operative to initially commence the formation of bends in a tube and to stretch the tube upon completion of formation of the bends in the tube.

2. An apparatus according to claim 1 wherein said expander means comprises a longitudinally extending expander bar, expander guide rail means slidably engaged with said lazy tong linkage, expander bar links pivotally interconnecting said expander bar and said expander guide rail means and expander drive means for moving said expander bar longitudinally to force said lazy tong linkage outwardly.

3. An apparatus according to claim 1 wherein said drive means includes chain drives and chain dolly blocks mounted on said chain drives and the outer carriage bars to draw the carriage bars towards the center.

4. An apparatus according to claim 1 wherein said bend forming means comprises bend support rails mounted at one end on said lazy tong linkage, and bend rollers mounted on the opposite end of said bend support rails.

5. An apparatus according to claim 4 wherein said one end of each bend support rail being pivotally mounted on said lazy tong linkage and slidably mounted on said lazy tong linkage intermediate the ends of said bend support rail.

6. An apparatus according to claim 1 and further including a center carriage bar fixed to said guide rails.

7. An apparatus according to claim 1 and further including a duplicate set of guide rails, carriage bars, lazy tong linkage and bend forming means mounted on said supporting base on the opposite side of said tube supporting means and with the duplicate bend forming means engaging the opposite surface of the tube or rod than said first named bend forming means whereby bends may be oppositely formed simultaneously to produce a serpentine configuration in a tube.

8. An apparatus for forming a tube into a serpentine configuration comprising a supporting base, an expander bar slidably mounted and extending longitudinally centrally of said supporting base, means for forming bends in a tube disposed on each side of said expander bar, each of said bend forming means comprising, a plurality of guide rails mounted on said supporting base and extending substantially parallel to said expander bar, a plurality of carriage bars extending transversely of said guide rails and slidably mounted thereon, a lazy tong linkage, means slidably mounting said lazy tong linkage on said carriage bars, support arms mounted on said lazy tong linkage and extending over said expander bar, bend rollers mounted on the inner end of each of said support arms, said bend rollers mounted on one side of the expander bar being engageable with the opposite side of a tube to be shaped and disposed over the expander bar, means operatively connected to said expander bar for forcing the lazy tong linkages on both sides of the expander bar outwardly on said carriage bars simultaneously to form initial bends in a tube to be shaped and drive means for driving said lazy tong linkages to a collapsed position to form the complete bends in the tube.

9. An apparatus according to claim 8 wherein said means for forcing the lazy tong linkages outwardly simultaneously includes expander guide rails slidably engaged with said lazy tong linkages and expander bar links pivotally interconnecting said expander bar and said expander guide rails.

10. An apparatus according to claim 8 wherein tube clamping means is mounted on the outermost carriage rails on one side of the expander bar.

11. A method of forming a plurality of bends in a tube or rod comprising the steps of securing a tube along a center line between two sets of lazy tong linkages, said lazy tong linkage extending parallel to said center line and having bend forming elements thereon with the bend forming elements engaging the tube, simultaneously forcing both sets of lazy tong linkages outwardly in opposite directions away from said center line with expander means to form initial bends in the tube, collapsing the lazy tong linkages together to form the tube into a serpentine configuration, and simultaneously forcing both sets of lazy tong linkages outwardly again in opposite directions away from said center line with said expander means to stretch the tube permanently into the serpentine configuration.

* * * * *